US005870866A

United States Patent [19]

Herndon

[11] Patent Number: 5,870,866

[45] Date of Patent: Feb. 16, 1999

[54] FOUNDATION AND SUPPORT SYSTEM FOR MANUFACTURED STRUCTURES

[75] Inventor: Thomas W. Herndon, Tool, Tex.

[73] Assignee: Foundation Manufacturing, Inc., Seven Points, Tex.

[21] Appl. No.: 889,556

[22] Filed: Jul. 8, 1997

[51] Int. Cl.[6] ..... E02D 27/00

[52] U.S. Cl. ..... 52/169.12; 52/299; 52/293.1; 52/126.6

[58] Field of Search ..... 52/169.1, 169.9, 52/169.12, 530, 586.1, 588.1, 126.6, DIG. 3, 293.1, 299

[56] References Cited

U.S. PATENT DOCUMENTS

| | | | |
|---|---|---|---|
| 2,990,588 | 7/1961 | McKinley . | |
| 3,256,655 | 6/1966 | Teeter . | |
| 3,562,983 | 2/1971 | Rector | 52/169 |
| 3,605,350 | 9/1971 | Bowers | 52/16 |
| 3,713,259 | 1/1973 | Tkach | 51/111 |
| 3,722,156 | 3/1973 | Bryant | 52/169 |
| 3,753,323 | 8/1973 | Nesbitt | 52/169 |
| 3,775,917 | 12/1973 | Struben | 52/169 |
| 3,827,201 | 8/1974 | Struben | 52/169 |
| 3,828,491 | 8/1974 | Koon et al. | 52/23 |
| 3,830,024 | 8/1974 | Warnke | 52/23 |
| 3,977,199 | 8/1976 | Chiaves | 61/39 |
| 4,007,568 | 2/1977 | Soble | 52/294 |
| 4,009,542 | 3/1977 | Houston | 52/73 |
| 4,010,584 | 3/1977 | Barnes, Jr. | 52/299 |
| 4,043,088 | 8/1977 | Payton | 52/169 |
| 4,261,149 | 4/1981 | Gustafson | 52/292 |
| 4,263,762 | 4/1981 | Reed | 52/293 |
| 4,400,919 | 8/1983 | Szabo et al. | 52/169 |
| 4,443,981 | 4/1984 | Weiss | 52/155 |
| 4,512,120 | 4/1985 | Lindal | 52/143 |
| 4,546,581 | 10/1985 | Gustafson | 52/169 |
| 4,738,061 | 4/1988 | Herndon | 52/126 |
| 5,524,405 | 6/1996 | Byrd | 52/295 |
| 5,590,494 | 1/1997 | Miller | 52/169.9 |
| 5,595,366 | 1/1997 | Cusimano et al. | 52/126.6 |
| 5,608,998 | 3/1997 | Hume | 52/245 |

OTHER PUBLICATIONS

Tobran Foundation System Brochures, Tobran Industries, a Texas Corporation (refers to Patent No. 4,738,061).

*Primary Examiner*—Carl D. Friedman
*Assistant Examiner*—Beth Aubrey
*Attorney, Agent, or Firm*—Locke Purnell; Rain Harrell

[57] ABSTRACT

The foundation and support system for a manufactured structure comprises a plurality of vertically adjustable supports fixedly mounted on footings in an excavated area under the structure. The adjustable supports are fixedly attached to main support stringers to support the weight and anchor the structure in the ground. A plurality of thin elongated foundation wall panels are cambered outwardly with respect to the periphery of the home to serve as a flexible retaining wall for backfill with the ability to flex along the longitudinal access to accommodate small movements in the home and strong winds without breaking or pulling out the fasteners and adds stability in the nature of tie downs which resist lifting. Three variations of the panels provide lap joints for running lengths and corners which may be sealed with flexible adhesive to resist entry of water in the space under the structure. The foundation wall panels are colored and textured to create the appearance of a site built home located at grade level.

15 Claims, 5 Drawing Sheets

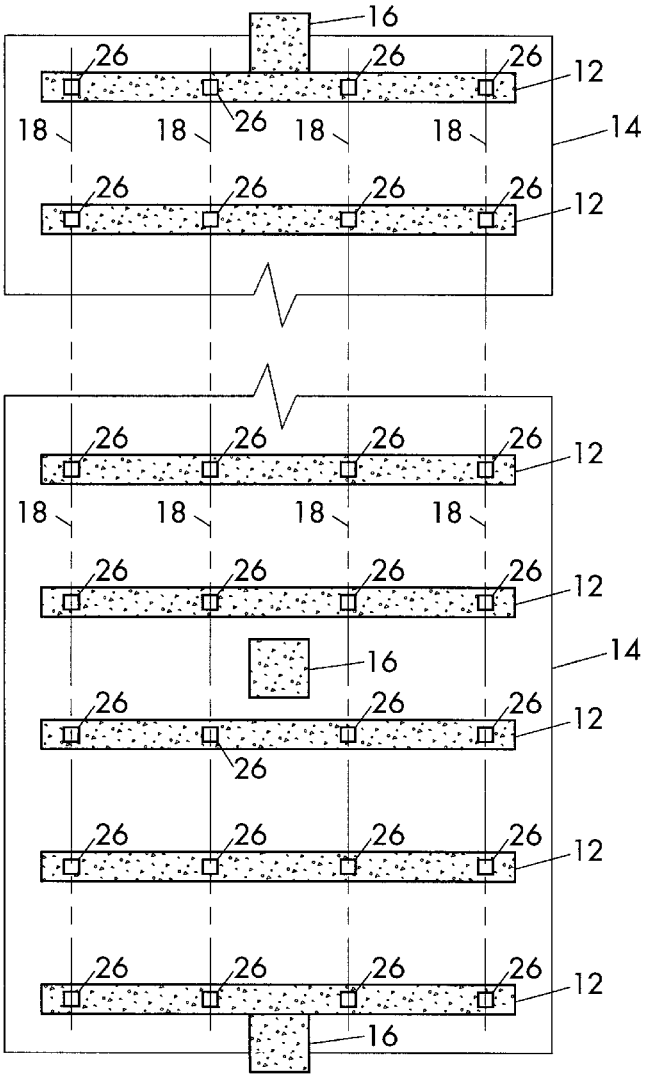
Fig. 1
Fig. 2
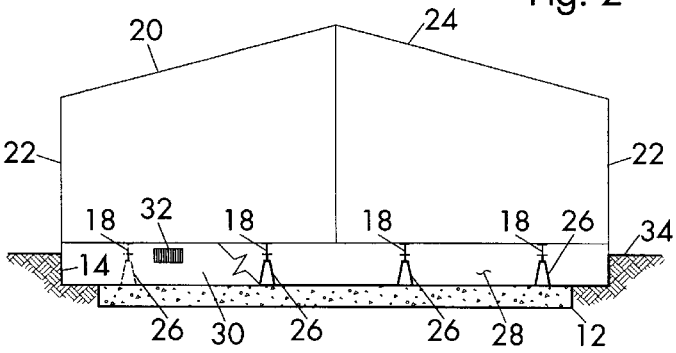
Fig. 3
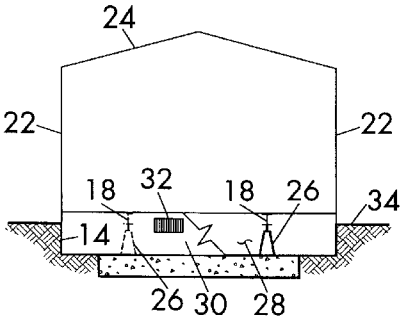

FOUNDATION AND SUPPORT SYSTEM FOR MANUFACTURED STRUCTURES

BACKGROUND OF THE ART

1. Field of the Invention

The invention relates to an improved foundation system for anchoring manufactured structures in place to withstand high winds.

2. Background of the Invention

Manufactured structures, especially manufactured housing and mobile homes, have a history of susceptibility to storm damage arising from high winds. A characteristic of these structures is that they are built on longitudinal frame members or stringers beneath the floors. The width and the structures themselves are designed for over the road transport. A typical 14 foot wide unit is built on two longitudinal frame members and two of these are put together to form a 28 foot wide unit on four longitudinal frame members. It is quite important that manufactured housing has the appearance of a site built home. This means, among other things, that the structure must be supported at about grade level. A common installation involves concrete pier footings upon which concrete blocks are placed at the desired height. Shims introduced between the concrete blocks and the bottom of the 10 or 12 inch longitudinal stringers of the structure are used as leveling devices. Tiedown straps about every 6 to 8 feet around the periphery of the structure are connected to "augers" which are screwed into the ground beneath the peripheral walls. Some kind of skirting is employed to hide the foundation. Codes require that the floor be at least 8 inches of above grade so that ground water cannot reach or damage the floor structure. Despite the use of numerous tiedowns at the edges and straps placed at intervals along the length over the roof structure, which can be tied down on either side of the structure, wind damage continues to be a major problem. Open space under manufactured housing can contribute to wind damage by creating a lifting effect in very strong winds.

An improved foundation system for manufactured homes is disclosed in U.S. Pat. No. 4,738,061. Footings set in an excavation in the ground have fixed thereto vertical support members which are attached to the longitudinal frame members of a manufactured building. The structure is supported at about grade level. A rigid system of overlapping fiberglass panels with vertical ribs define a retaining wall for backfilling around the outside perimeter of the structure. Rigidity of the fiberglass panels against being caved in by the backfill is provided by a series of triangular shaped vertical reinforcing ribs spaced at 1-foot intervals along the panel. This makes for a difficult and expensive construction process. These panels are composite structures of fiberglass and wood in which the triangular wood stiffeners are encapsulated between two layers of fiberglass in order to prevent deterioration of the wood caused by the combination of moisture and various organisms. This structure is mechanically complicated and expensive. It is costly to rip the wood, lay it in and work fiberglass around it so it doesn't cut the glass. Consequently this structure consumes more fiberglass resin than would a flat panel. It is difficult to control the amount of materials and uniformity of the structure with a composite of this shape employing wood. It would be desirable to have a simple less expensive structure not difficult to manufacture, for a supporting system of this kind, which securely anchors a manufactured structure at grade level. It would also be desirable to produce a simpler support structure which supports vertical loads and horizontal wind forces using less material which is less expensive than the structure shown in the patent. An improved support structure of this kind which provides solid support at grade level for manufactured housing which is simpler, less costly to make and to install is the subject of the present invention.

SUMMARY OF THE INVENTION

The present invention is a foundation and support system for supporting a manufactured structure or a manufactured home at grade level on a permanent foundation. The invention includes a partly decorative, partly structural perimeter foundation wall made from thin panels which creates the appearance of a concrete foundation to make a manufactured home look like a structure made on site. The system includes support members attached to the underlying frame structure of the home which carry the vertical load of the structure and resist horizontal forces from any direction generated by wind pressure on the sides of the building. The vertical supports are rigidly set on concrete pier footings or spread footings appropriate to the type of soil and the local codes. The vertical supports are adjustable in a transverse direction with respect to longitudinal frame members beneath the floor of the structure.

The supports adjust vertically for purposes of leveling the structure. There are a plurality of supports mounted on footings spaced along the main longitudinal frame members or stringers which anchor the structure to the site. Typically some structures have two main I-beams as in a single structure or four main I-beams in a double-wide structure. Outriggers about 2.5 feet long are placed about every 4 feet to extend out to the sides of the structure where peripheral walls are found. The outriggers are positioned transversely with respect to the main longitudinal beams.

A plurality of vertically disposed foundation wall panels, having an upper edge and a lower edge with an intermediate panel portion between the edges are positioned around the perimeter of the house under the floor below where the perimeter walls are located. The foundation walls panels typically have a transverse width of about 2 feet and are about 8 feet long. The upper edge of the panels has an upper flange and the lower edge has a lower flange whereby the foundation wall panel can be disposed vertically below the perimeter walls by attachment of the upper flange with fasteners to a longitudinal plate on the underside of the perimeter walls. The lower flange is supported on the earth in the excavation and may be held in place by "rebar" pins or other means.

The improved foundation wall panels are thin elongated panels shaped to have an arcuate intermediate panel section which is cambered outwardly with respect to the periphery of the home to serve as a flexible retaining wall for backfill. The improved panels have the ability to flex along the longitudinal axis of the elongated panels so as to accommodate small movements of the home in strong winds without breaking or pulling out the fasteners over time and to add stability to the system through interaction of the bottom flange with the backfill to resist lifting. Since the upper flange of the panel is fixed to the sill or plate beneath the floor and the lower flange of the panels preferably rests on undisturbed or tamped earth in the excavation, the springy cambered panels are easier to install than a flat panel would be since they can give in a transverse direction to fit in a finite vertical space. Though the cambered panels are only about one-eighth of an inch thick and flexible, they successfully act as a retaining wall against the usual forces imposed by backfill. The panels are pigmented gray and remain rough to look like concrete.

Some of the foundation wall panels have offset opposite side edge portions along the intermediate panel sections which extend beyond the upper and lower flanges. These edge portions have the same camber as the arcuate cambered panels and are thus adapted to mate with an overlapping side edge portion of a cambered companion panel without leaving a gap.

Some of the foundation wall panels have a right angled extension of the intermediate panel section along the side edge between the upper and lower flanges. These right angled extensions are adapted to overlap the side edge of a companion panel arranged in right angled orientation therewith at a corner of the perimeter wall. The right angled extension is a flange-like extension with the same camber as the arcuate panel in order to form a close fitting overlap joint at the side edge of a cambered companion panel. Some panels are preferably made straight without any specialized side edges. This combination of panels minimizes the chance of waste when cutting panels to fit around the perimeter of a manufactured structure. It also provides a joint that cannot be seen from a distance away. The joints can be caulked to prevent casual water from reaching the foundation.

The vertically adjustable supports have a base plate on which is mounted a plurality of upright supports having an upper end portion with a threaded opening. A threaded stem in the opening vertically and adjustably supports a bearing plate for the stringers under the manufactured structure. The upright supports are preferably triangular shapes which taper in as they rise to the top which are arranged in a crossed arrangement to provide resistance to horizontal forces applied by the wind to any side of the structure to which they are attached. A gap between the supports in the middle allows room for the threaded stem when making adjustments.

BRIEF DESCRIPTION OF THE DRAWINGS

FIG. 1 is a plan view of an excavation for a double wide manufactured structure having a spaced series of spread footings and a plurality of vertically adjustable supports fixed on the footings where main longitudinal supports will be found;

FIG. 2 is an elevation view of the excavation and foundation of FIG. 1 with a double wide modular structure supported by the foundation and support system wherein the structure has four longitudinal main stringers which each receive support from one set of the vertically adjustable supports;

FIG. 3 illustrates an elevation view of a single wide manufactured home having two main supporting I-beams supported on a foundation and support system like that of FIGS. 1 and 2;

DETAILED DESCRIPTION OF THE PREFERRED EMBODIMENT

Figure 4:
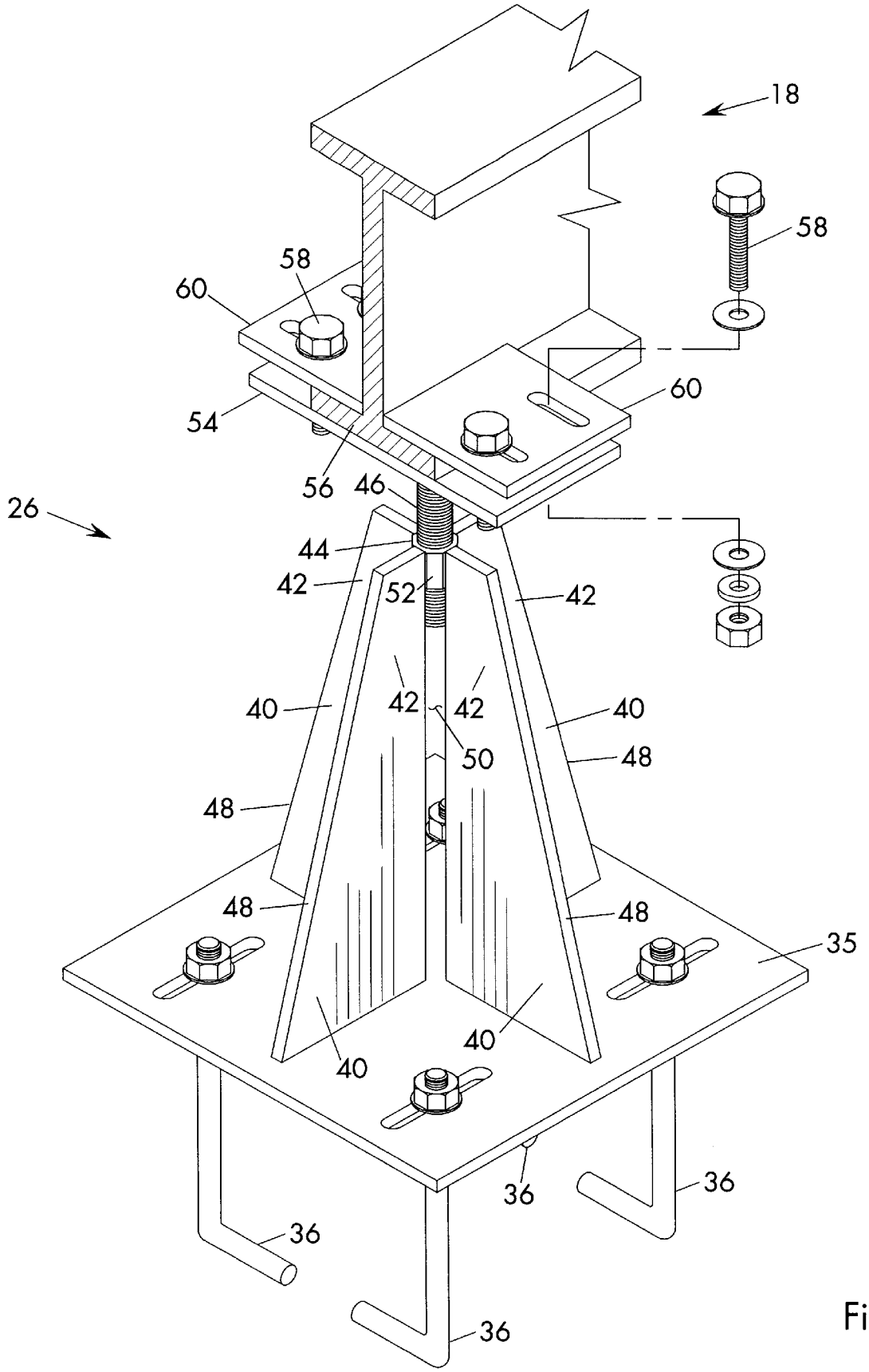
FIG. 4 is an isometric view of a preferred form of the adjustable vertical support which is formed on a base plate which is grouted into the footings.

The foundation and support system of the present invention is referred to generally by the reference number 10 in FIG. 1. Spread footings 12 which run transversely in FIG. 1 are arranged according to soil conditions in excavation 14. Although it may vary, excavation 14 is suitably about 2 feet deep. Concrete pier footings or any other suitable footings can be utilized as well. Excavation 14 may contain additional concrete pads 16 which may have vertical uprights to support the ridge of a manufactured home. Dotted lines 18 represent the position of longitudinal frame members 18 which lie beneath the floor of the manufactured structure 20 in FIG. 2. Manufactured structure 20 will most commonly be a double wide home what could also be a storage building, a kiosk or other type of manufactured structure. Manufactured structure 20 has perimeter walls 22 had a roof 24. There are four perimeter walls, one at each side and one at each end of the structure.

A plurality of vertically adjustable supports 26 are anchored preferably via "anchor" bolts to footings 12 along the line of longitudinal frame members or stringers 18 to carry the entire weight of the manufactured structure. These are seen in detail in FIGS. 4 and 5. They are adjustable over a range of several inches in a vertical direction to facilitate leveling the structure. A crawl space 28 is established under the floor. A plurality of vertically disposable foundation wall panels 30 partly cut away in FIGS. 2 and 3 nearly directly under perimeter walls 22 will be discussed in detail later. Foundation wall panels 30 preferably include a plurality of vents 32 above grade level 34. FIG. 3 illustrates the identical foundation and support system in a smaller excavation 14' for a single home unit.

Figure 5:
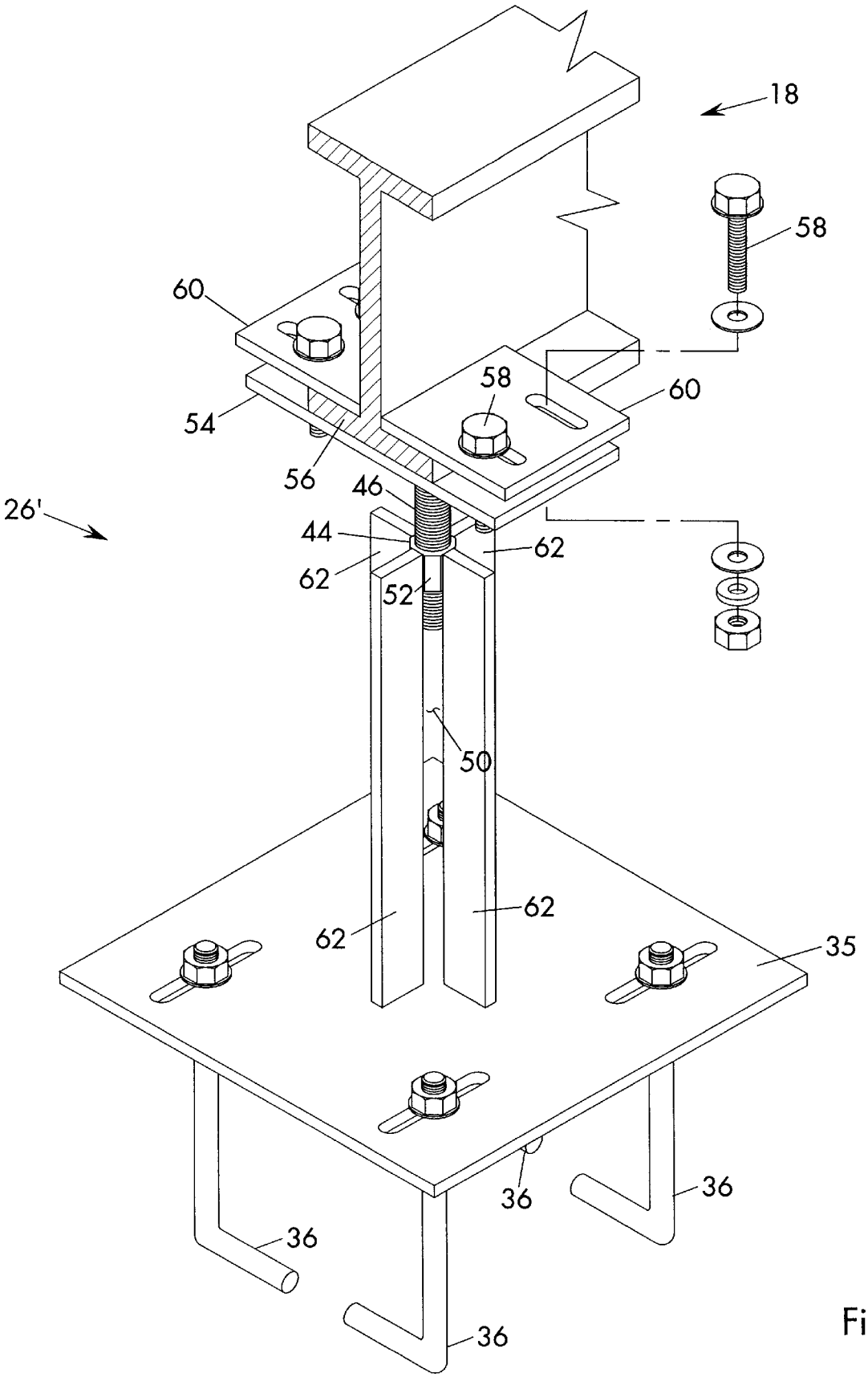
FIG. 5 is an alternate form of the preferred embodiment of the vertically adjustable support which is clamped to the lower flange of a main I-beam support for the manufactured structure.

Turning now to FIGS. 4 and 5, vertically adjustable supports 26 will be described. A plurality of "anchor" bolts 36 are embedded in the concrete footings in support of base plate 38. Base plate 38 has slots running transversely which permit a limited amount of lateral movement of the vertical supports so they will line up with the stringers 18. Upright supports 40 are welded or otherwise fixed in a vertical orientation to base plate 38. Supports 40 have an upper end portion 42 containing a threaded opening 44 which receives a threaded stem 46. Upright supports 40 have a triangular shape with outer edges 48 which taper as they rise upwardly and a separation in the middle which creates a central space 50 to allow room for threaded opening 44. Threaded opening 44 is economically made by welding nut 52 into upper end portion 42 at the inner edges of upright supports 40.

An adjustable bearing plate 54 is fixedly attached to the upper end of threaded stem 46 to support lower flange 56 of longitudinal frame members 18. Suitable bolts 58 attach clamping plates 60 to lower flange 56 and bearing plate 54. In the event stringers 18 are made of wood, clamping plates 60 can be made as sections of angle iron with openings to permit bolts to be passed through the wooden stringers and secure them to bearing plate 54. It is important that the longitudinal frame members be supported to keep them from rising from the frame members when the structure is subject to strong winds. The crossed arrangement of upright members 40 provides structural support to the weight of the home as well as fixedly resisting horizontal forces imposed on the structure from any direction. More or fewer of the upright members could be used in a different arrangement so long as they will withstand horizontal forces to keep the home from moving in any direction.

FIG. 5 shows a nearly identical vertically adjustable support 26" which reduces the amount of material needed, for lighter weight manufactured homes. Triangular shaped upright supports 40 are replaced by rectangular shaped straps 62 arranged vertically and separated at the inner edges to provide room for adjustment of the threaded stem 46. It can be seen that either version of the vertically adjustable supports are economically made from welded plate sections and easily procured parts.

Figure 6:
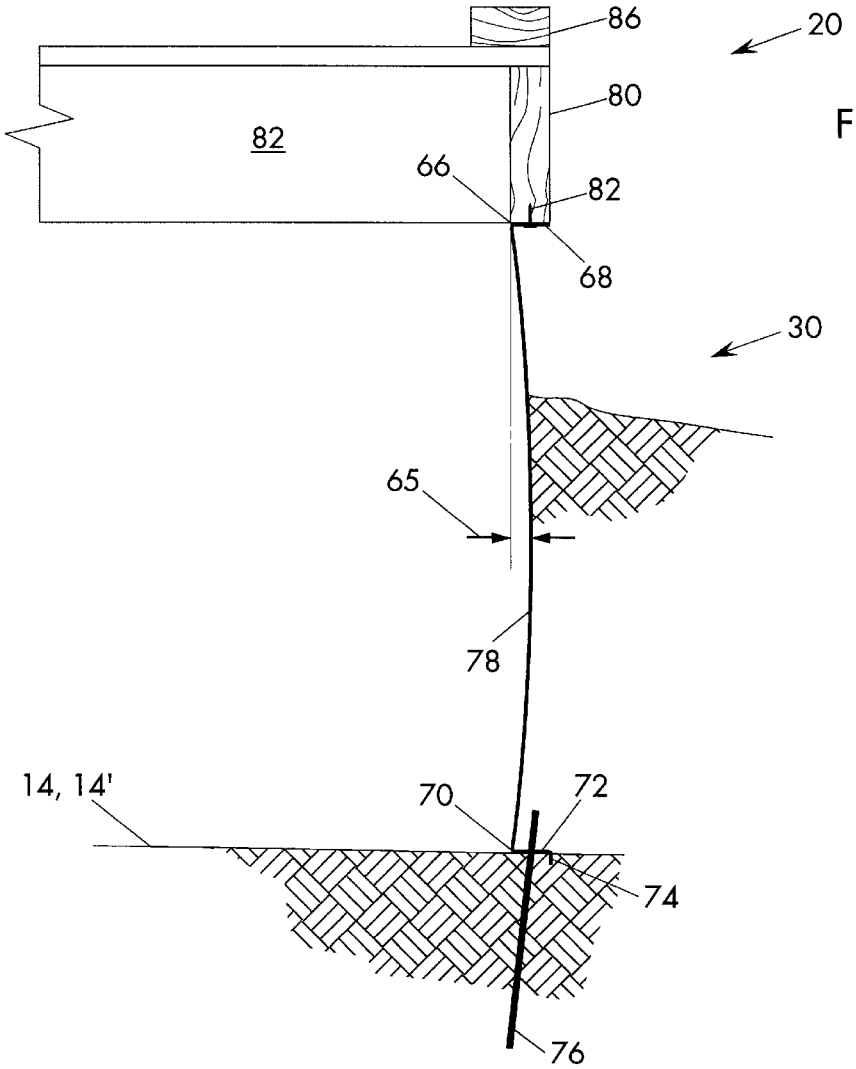
FIG. 6 is a side elevation showing an improved foundation wall panel having an upper flange fastened to a plate under the flooring of a manufactured structure under the perimeter walls wherein the arcuate outer surface is restraining backfill.
Figure 7:
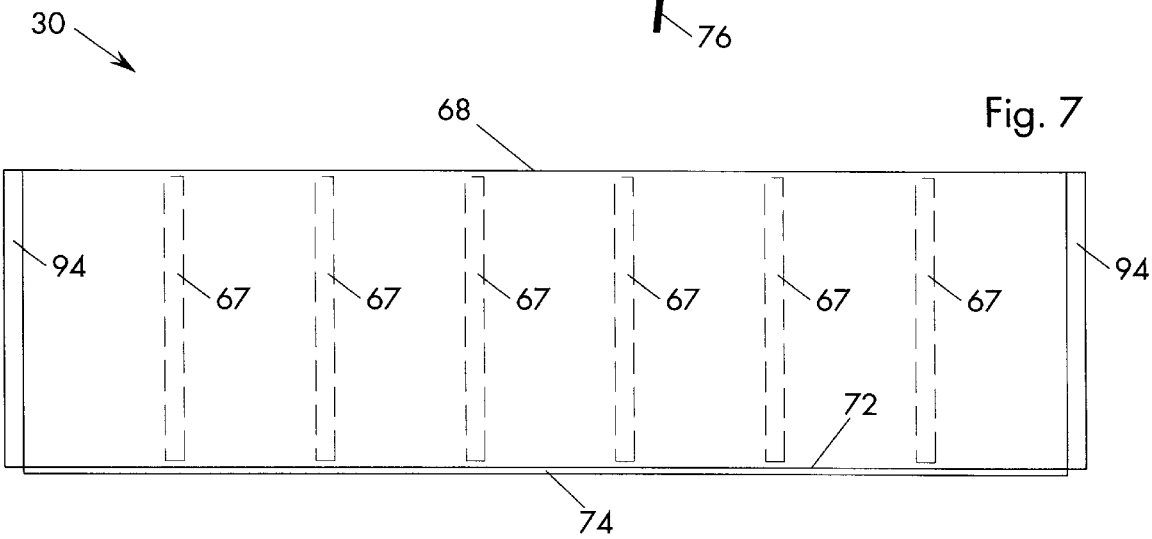
FIG. 7 is a plan view of the arcuate foundation wall panel of FIG. 6.
Figure 9:
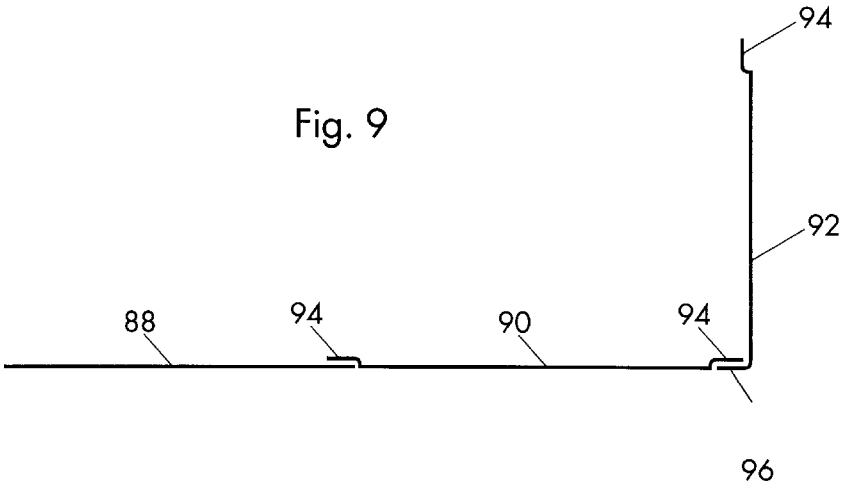
FIG. 9 is a schematic top view of the three types of foundation wall panels shown in FIG. 8 to illustrate how the side edges interlock.
Figure 8:
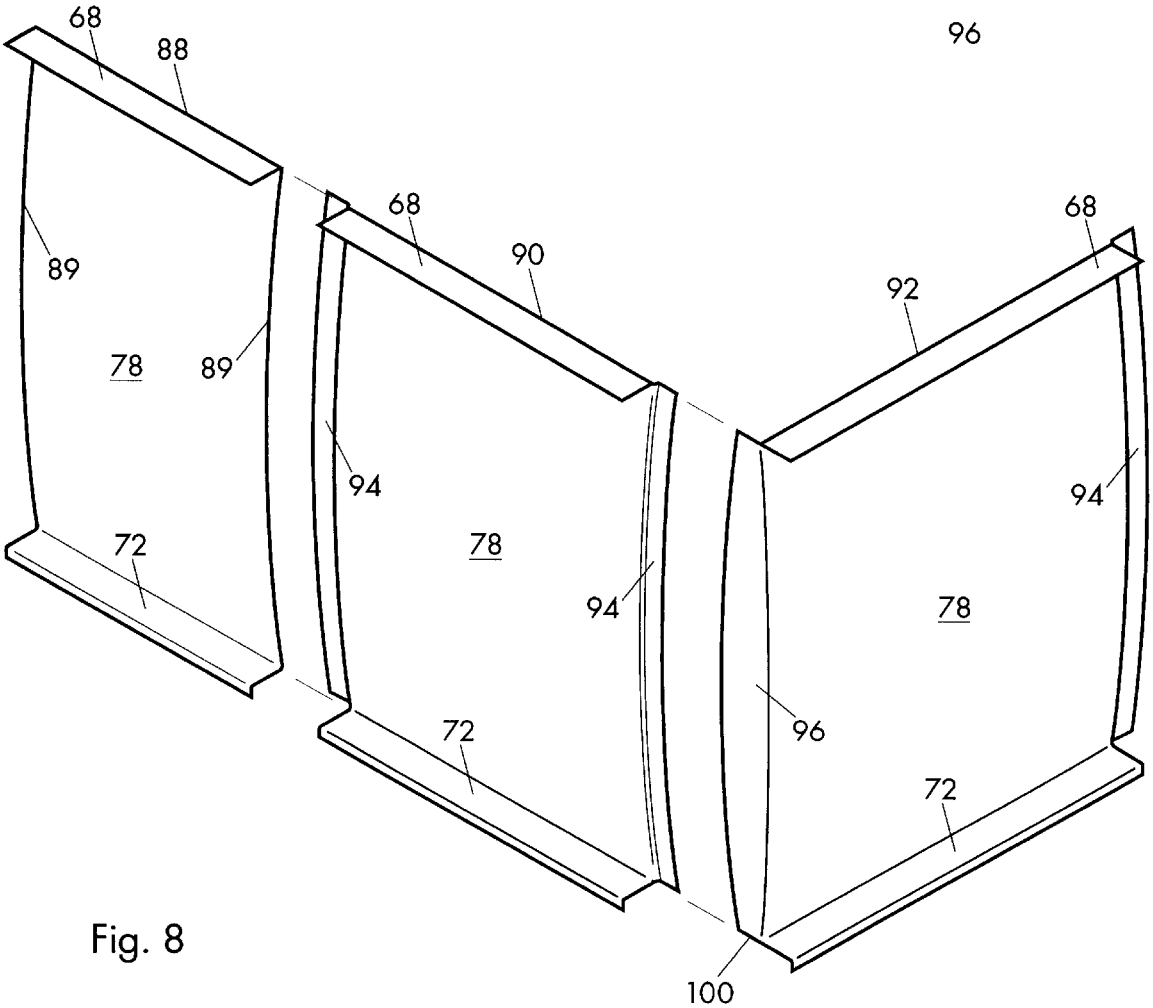
FIG. 8 is a pictorial view of three variations of the foundation wall panel of FIG. 6 showing arcuate surfaces and arcuate side edge portions which overlap to form a close fitting seal between adjoining cambered panels.

Referring now to FIGS. 6 through 9, the foundation wall panels 30 are seen in greater detail. An isometric view of the panels is shown in FIGS. 8 and 9 somewhat shortened in the longitudinal direction for ease of illustration. The panels are typically 2 feet wide by 8 feet long, although they could be made in longer lengths or a greater width if they can be conveniently transported to the site.

Surprisingly, it has been found that a thin flexible panel 30 can be employed to act as a retaining wall for the backfill if it is made in the proper shape. The preferred material is a semi-rigid fiberglass which can flex to a limited degree without cracking or breaking. Panels 30 only about ⅛th inch thick which are cambered outwardly with respect to the periphery of the structure successfully resist collapsing under forces imposed by backfill 64 when excavation 14 is brought up to grade level. It has been found unnecessary to use a rigid foundation wall panel to serve as a retaining wall. Since the arcuate shape is fixed in the fiber glass as it is molded, panels 30 retain the camber 65 as indicated by the arrows in FIG. 6. In addition to the economy of materials and ease of fabrication, there are additional advantages to the cambered foundation wall panels which will be discussed later.

In FIG. 6, panel 30 has an upper edge 66 with an upper flange 68, a lower edge 70 with a lower flange 72 which may contain a cleat 74 to help stabilize lower edge 70 from lateral movement with respect to the excavation 14. Lower flange 72 may contain a series of longitudinally spaced openings. A short section of rebar 76 can be used to anchor lower flange 72 on the floor of the excavation. Between edges 66, 70, foundation wall panel 30 has an intermediate panel portion 78 which is an arcuate intermediate panel section offset laterally from the shortest straight distance between upper and lower edges 66, 70 by the amount of camber 65. Intermediate panel section 78 has the ability to flex along the longitudinal axis of panels 30 such that the amount of camber 65 is increased or decreased and the absolute distance between flanges 68 and 72 is likewise altered. Upper flange 68 is attached to the underside of a plate 80 of each peripheral side wall or end wall of structure 20 by means of fasteners 82. Plate 80 may be attached to the outboard ends of short transversed joists 84 directly under perimeter wall 86. Just the base 86 of the perimeter wall 22 is shown.

Additional advantages have been found with the use of the cambered foundation wall panels in that the camber will slightly increase or decrease so as to accommodate small movements of the home in strong winds without breaking or pulling out fasteners 82 over time and then in this sense, act somewhat like a spring. Small movements of the home result in an increase or decrease in the absolute distance between the plate 80 and excavation 14 in a vertical direction. Still further, the cambered panels are easier to install in a fixed distance between excavation 14 and plate 80 because they can give in the vertical direction by increasing or decreasing camber 65 as they are installed. The panels are preferably cambered laterally at least about ½ inch from the position of an uncambered flat panel. Finally, since flange 72 is secured under backfill, it resists lifting so the entire series of foundation wall panels act as springy tiedowns which further stabilize the structure.

A plan view of a foundation wall panel 30, like panel 90 in FIG. 8, is shown in FIG. 7. This view shows an additional feature of panel 30 which has been found useful for marketing purposes. A spaced series of very thin stabilizing strips 67 are transversely placed with respect to the panel 30 between two layers of the fiberglass. These are flat strips only 3 millimeters thick by 1 foot 11 inches long and 1½inches wide in a suitable arrangement. They are sold under the trademark Firet Coremat XM™ by Lanfor Plastics, LaGrange, Ga. A suitable resin used to make the fiberglass panels is sold under the trademark Stypol® by Cook Composites and Polymers Co., Kansas City, Mo. as a hand lay-up or spray-up application with good corrosion resistance. The reason the "coremat" structures are embedded in the fiberglass is to improve the feel and handling of the panels 30 so that they don't feel "flimsy" to the buyers. The "coremat" adds some stiffness, but is not needed after the installation is made and do not prevent the panels 30 from flexing.

Three different shapes of the foundation wall panels 88, 90 and 92 seen in FIG. 8 greatly increase the efficiency of material utilization since panels 30 are mass produced in standard lengths. Panel 88 is a plain panel variation with straight cut side edges 89 along the plane of a transverse cut. Panels 90 have offset opposite side edge portions 94 along intermediate panel section 78 which extend outward beyond upper and lower flanges 68, 72. Opposite offset side edge portions 94 are mirror images of each other having the same camber as arcuate panel 78 and are thus, adapted to mate with an overlapping side end portion of a cambered companion panel, such as panels 88 or 92. The arrangement of the lapped edges is shown in FIG. 9.

Panel 92 is designed for use at a corner. Panels 92 have one offset side edge portion 94 along one side edge and a right angled extension 96 of arcuate panel 78 at the opposite side edge. Angled side edge extension 96 has the same camber as arcuate panel 78 and offset side edge portions 94 and extends all along the edge of arcuate panel 78 between upper and lower flanges 68, 72. Right angled extension 96 is adapted to overlap a side edge extension 94 or part of panel 78 of panel variation 88. Right angled side edge extension 96 preferably has an overall transverse width between upper and lower edges 98 and 100 such that right angle side extension 96 will fit snugly between flanges 68, 72 of a panel variation 88. This makes a neat, close fitting lap joint which is nearly visually indistinguishable from the panels themselves.

It can be seen that with these three panel variations, the foundation wall panels can be placed as shown in FIG. 6 around the entire perimeter of a manufactured structure with an overlap between each panel edge and a minimum of wasted panel. Even if a panel 88 must be cut to fit along the usual 50 to 80 foot length of a manufactured home, it is likely less than a portion of one eight foot panel will be overage due to fitting the panels around the perimeter. Even this can be utilized on the next job.

Codes generally require that the floor of a manufactured home be raised about 8 inches above grade in order to avoid casual water which leads to deterioration of this structure. There are code requirements for drainage away from the foundation and it is preferable to include "french drains" or some means of keeping the excavation space 102 dry under the floor. Since the overlapping edges 94 and 96 fit closely against an adjacent cambered panel, a silicone or other flexible adhesive can be placed between the laps to produce a water proof joint. This would tend to keep rain water from being able to leak into excavation space 102. Although excavation space 102 is only about 2 feet deep, it can be utilized as an emergency tornado shelter. Even if a tornado would tear the structure away, the anchored stringers and floor would likely remain and serve as protection for occupants. The fiberglass panels are pigmented gray and are rough to simulate the appearance of concrete. Thus they serve a decorative function which make the manufactured home look like a site built home.

Whereas, a preferred form of the invention as been described with respect to specific embodiments, various changes and modifications will be suggested to one skilled in the art and such changes and modifications are intended to be encompassed which fall within the scope of the appendant claims.

I claim:

1. A foundation and support system for supporting at grade level, a manufactured structure with a floor, longitudinal frame members beneath the floor, and perimeter walls wherein the structure is supportable over an excavated area having footings, the structure including flexible foundation walls which decoratively enclose the excavated area at the perimeter walls and connect to back fill, the support system comprising:

a plurality of vertically adjustable supports which can be fixedly mounted on the footings in support of the longitudinal frame members of the structure and removably attached thereto whereby the weight of the structure can be fully supported over the excavation at about grade level;

a plurality of vertically disposable foundation wall panels having an upper edge, and a lower edge with an intermediate panel portion therebetween, said upper edge having an upper flange and said lower edge having a lower flange wherein said foundation wall panels can be disposed vertically under the perimeter walls of said structure by attachment of the upper flange thereto with fasteners and wherein the lower flange is adapted to be supported in the excavated area and can be covered with the backfill;

said foundation wall panels being shaped to have an arcuate intermediate panel section offset laterally from the shortest straight distance between the upper and lower edges and whereby the foundation wall panels serve as a flexible retaining wall to retain backfill of the structure to grade, said foundation wall panels being able to flex to accommodate small movements of the structure in strong winds without breaking or pulling said fasteners out, said foundation wall panels acting as a spring tiedown around the structure that adds stability to the system.

2. The foundation and support system of claim 1 wherein said arcuate panels are cambered laterally at least about one half inch.

3. The foundation and support structure of claim 2 wherein the foundation wall panels are constructed of fiberglass from a first and second layer of fiberglass which contain between the layers a series of transversely oriented flat elongated stiffeners which do not add appreciably to the overall thickness of the panels.

4. The foundation and support structure of claim 2 wherein some of said foundation wall panels have offset opposite side edge portions along the intermediate panel sections which extend beyond the upper and lower flanges, the offset side edge portions having the same camber as the arcuate panels and are thus adapted to mate with an overlapping side end portion of a cambered companion panel.

5. The foundation and support structure of claim 2 wherein some of said foundation wall panels have a right angled extension of the intermediate panel section along the side edge between the upper and lower flanges adapted to overlap the side edge of a companion panel arranged in right angled orientation thereto at a corner of the perimeter.

6. The foundation and support structure of claim 5 wherein the right angled extension of the intermediate panel section is a flange like extension with the same camber as the arcuate panel to form a close fitting overlap joint at the side edge of a cambered companion panel.

7. The foundation and support structure of claim 2 wherein the plurality of vertically adjustable supports have a base plate on which is mounted a plurality of upright supports having an upper end portion having a threaded opening which receives a threaded stem that vertically adjustably supports a bearing plate.

8. The foundation and support structure of claim 7 wherein the plurality of upright supports are generally triangular shapes which taper in as they rise toward the top, said upright supports being separated in the middle to allow room for the threaded stem.

9. The foundation and support section of claim 8 wherein the triangular shapes are mounted in a crossed arrangement.

10. In a foundation and support system for supporting a manufactured home at grade level over a footed excavation, the home having subfloor stringers, a floor, peripheral walls above the floor, structural plates arranged under the floor around the periphery of the home, and spaced apart supports mounted upon footings in the excavation which are attached to the subfloor stringers of the home, the improvement comprising:

a plurality of vertically disposed flexible foundation wall panels having an upper side and a lower side having flanges along the upper side being attachable with fasteners to the structural plates around the perimeter of the home and for securing the bottom of the panel to the ground in the excavation below grade level;

said foundation wall panels being elongated and cambered outwardly with respect to the periphery of the home to serve as a flexible retaining wall for backfill with the ability to flex along the longitudinal axis of the elongated panels so as to accommodate small movements of the home in strong winds without breaking or pulling out the fasteners over time and to add stability to the system through interaction of the bottom flange with backfill which resists lifting.

11. The foundation and support system of claim 10 wherein said foundation wall panels are cambered laterally at least about one half inch from the position of an uncambered flat panel.

12. The foundation and support structure of claim 11 wherein the foundation wall panels are constructed of fiberglass from a first and second layer of fiberglass containing between the layers a series of transversely oriented flat elongated stiffeners which do not add appreciably to the overall thickness of the panels.

13. The foundation and support structure of claim 11 wherein some of said foundation wall panels have an offset side edge portion with the same camber as the panel, for overlapping an adjacent panel.

14. The foundation and support structure of claim 13 wherein at least some of the foundation wall panels have a right angled extension along the side edge between the upper and lower flanges wherein the right angled extension is a flange-like cambered extension with the same camber as the panel to form a close fitting overlap joint at the side edge of a cambered companion panel.

15. The foundation and support structure of claim 14 wherein the foundation wall panels are constructed of fiberglass from a first and second layer of fiberglass containing between the layers a series of transversely oriented flat elongated stiffeners which do not add appreciably to the overall thickness of the panels.

* * * * *